US011454249B2

(12) United States Patent
Chen et al.

(10) Patent No.: US 11,454,249 B2
(45) Date of Patent: Sep. 27, 2022

(54) HEAT DISSIPATION FAN

(71) Applicant: Acer Incorporated, New Taipei (TW)

(72) Inventors: Tsung-Ting Chen, New Taipei (TW); Wei-Chin Chen, New Taipei (TW); Cheng-Wen Hsieh, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/148,579

(22) Filed: Jan. 14, 2021

(65) Prior Publication Data

US 2021/0215170 A1 Jul. 15, 2021

(30) Foreign Application Priority Data

Jan. 14, 2020 (TW) ..... 109101239

(51) Int. Cl.

| | |
|---|---|
| ***F04D 29/28*** | (2006.01) |
| ***F04D 29/42*** | (2006.01) |
| ***F24F 7/007*** | (2006.01) |

(52) U.S. Cl.

CPC ..... *F04D 29/4226* (2013.01); *F04D 29/281* (2013.01); *F24F 7/007* (2013.01)

(58) Field of Classification Search

CPC ..... F04D 29/281; F04D 29/30; F04D 29/4226
See application file for complete search history.

(56) References Cited

U.S. PATENT DOCUMENTS

| | | | | |
|---|---|---|---|---|
| 4,521,154 | A * | 6/1985 | Corbett | F04D 29/281 416/182 |
| 6,877,954 | B2 * | 4/2005 | Lin | F04D 29/30 416/185 |
| 8,109,731 | B2 * | 2/2012 | Keber | F04D 29/023 416/186 R |
| 8,292,588 | B2 * | 10/2012 | Otsuki | F04D 29/281 415/206 |
| 8,882,467 | B2 * | 11/2014 | Kwok | F04D 29/281 416/214 R |
| 2007/0098571 | A1 * | 5/2007 | Nagamatsu | F04D 29/281 417/354 |
| 2011/0176916 | A1 * | 7/2011 | Liang | F04D 29/663 415/203 |
| 2021/0071681 | A1 * | 3/2021 | Hsu | F04D 29/282 |

FOREIGN PATENT DOCUMENTS

| | | |
|---|---|---|
| CN | 2699019 | 5/2005 |
| CN | 100425935 | 10/2008 |
| CN | 201689608 | 12/2010 |
| CN | 103795897 | 5/2014 |
| CN | 104424537 | 3/2015 |
| CN | 204900330 | 12/2015 |
| CN | 205273872 | 6/2016 |
| CN | 105344101 | 8/2016 |

(Continued)

*Primary Examiner* — Ninh H. Nguyen
(74) *Attorney, Agent, or Firm* — JCIPRNET

(57) ABSTRACT

A heat dissipation fan including a housing, a hub, and a plurality of blades is provided. The hub is rotatably disposed in the housing. The blades are disposed at a surrounding edge of the hub to be rotated with the hub. When the heat dissipation fan is operated, at least one flow path is formed by two adjacent blades, and the flow path has a reduction section away from the hub.

17 Claims, 9 Drawing Sheets

(56) References Cited

FOREIGN PATENT DOCUMENTS

| | | |
|---|---|---|
| CN | 103414562 | 7/2017 |
| CN | 104888405 | 12/2017 |
| TW | 201132857 | 10/2011 |
| TW | I386151 | 2/2013 |
| TW | I445547 | 7/2014 |
| TW | I490413 | 7/2015 |
| TW | I510389 | 12/2015 |
| TW | M532604 | 11/2016 |
| TW | I579304 | 4/2017 |
| TW | I607751 | 12/2017 |
| TW | I608012 | 12/2017 |
| TW | I627184 | 6/2018 |
| TW | I628189 | 7/2018 |
| TW | I636789 | 10/2018 |
| TW | I638048 | 10/2018 |
| TW | M569794 | 11/2018 |
| TW | I658214 | 5/2019 |
| WO | 2017028250 | 2/2017 |
| WO | 2017028704 | 2/2017 |

* cited by examiner

HEAT DISSIPATION FAN

CROSS-REFERENCE TO RELATED APPLICATION

This application claims the priority benefit of Taiwan application serial no. 109101239, filed on Jan. 14, 2020. The entirety of the above-mentioned patent application is hereby incorporated by reference herein and made a part of this specification.

BACKGROUND OF THE INVENTION

Field of the Invention

The invention relates to a fan, and more particularly, to a heat dissipation fan.

Description of Related Art

Generally speaking, in order to improve the heat dissipation effect in a notebook computer, the thermal resistance of the system is reduced or the performance of the heat dissipation fan therein is improved. However, since the appearance of the notebook computer is light and thin, and the number of heat dissipation holes is usually kept to a minimum, the thermal resistance of the system is greater, thus reducing the air intake of the heat dissipation fan, so that air from the external environment does not readily enter the system to generate the thermal convection needed for heat dissipation.

At the same time, the air gap between the blades of existing centrifugal fans is greater, and therefore the air flow is not easy to control so that backflow readily occurs, such that wind pressure is insufficient, and thus affecting heat dissipation efficiency.

Accordingly, since existing systems already have thermal resistance, an effective means of improving the wind pressure capability of the heat dissipation fan is needed to effectively solve the above issues.

SUMMARY OF THE INVENTION

The invention provides a heat dissipation fan, wherein wind pressure is effectively increased by generating at least one flow path between blades and forming a reduction section in the flow path.

A heat dissipation fan of the invention includes a housing, a hub, and a plurality of blades. The hub is rotatably disposed in the housing. The blades are disposed at a surrounding edge of the hub to be rotated with the hub. When the heat dissipation fan is operated, at least one flow path is formed by two adjacent blades, and an end of the flow path away from the hub has a reduction section.

Based on the above, in the heat dissipation fan, at least one flow path is formed between the blades, and at the same time the flow path is provided with a reduction section, and therefore a pressurizing effect is provided to the airflow flowing through the reduction section, thereby increasing the air pressure of the heat dissipation fan so as to effectively solve existing heat dissipation issues.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
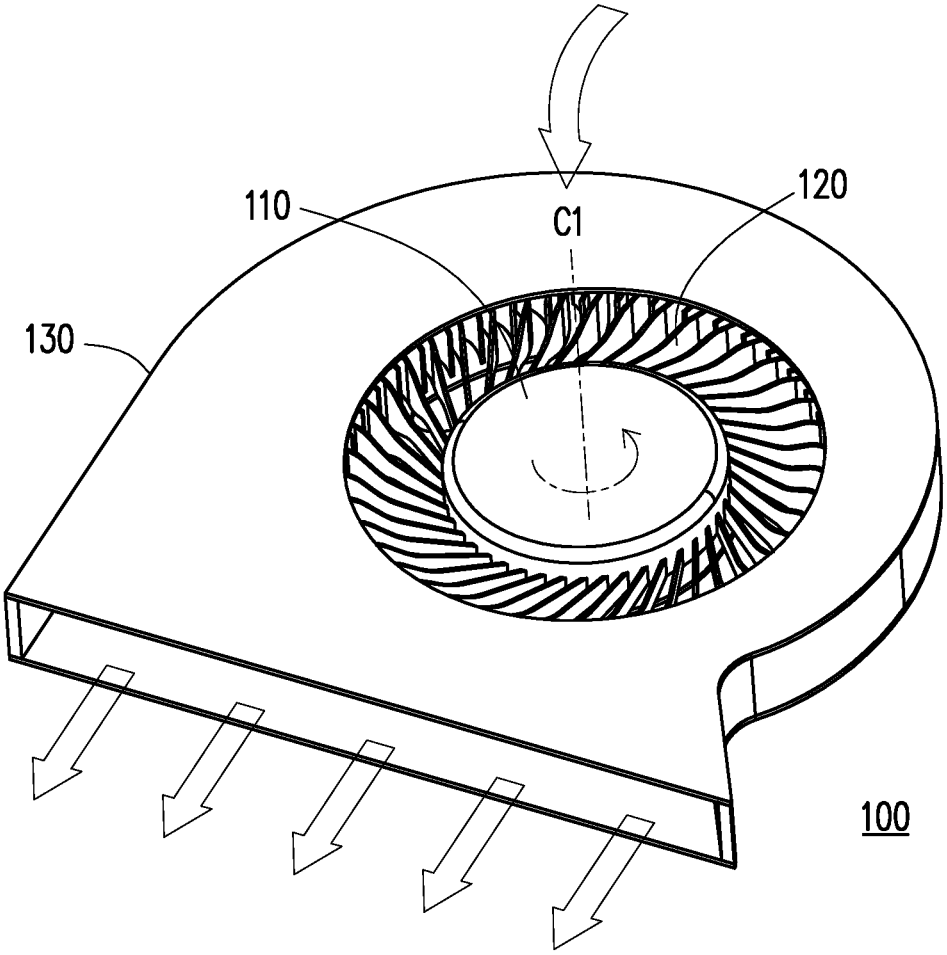
FIG. 1A is a schematic of a heat dissipation fan according to an embodiment of the invention.
Figure 1B:
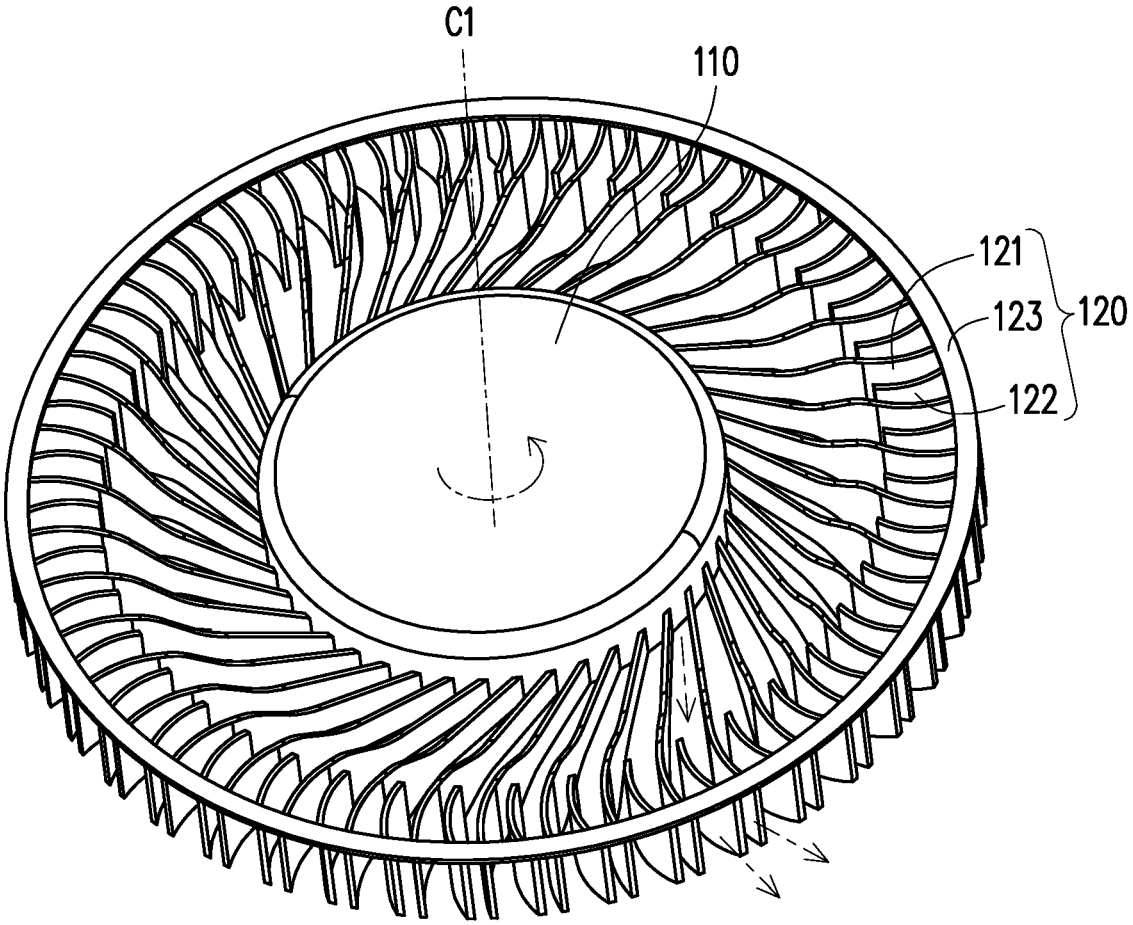
FIG. 1B is a schematic of a hub and blades in the heat dissipation fan of FIG. 1A.
Figure 1C:
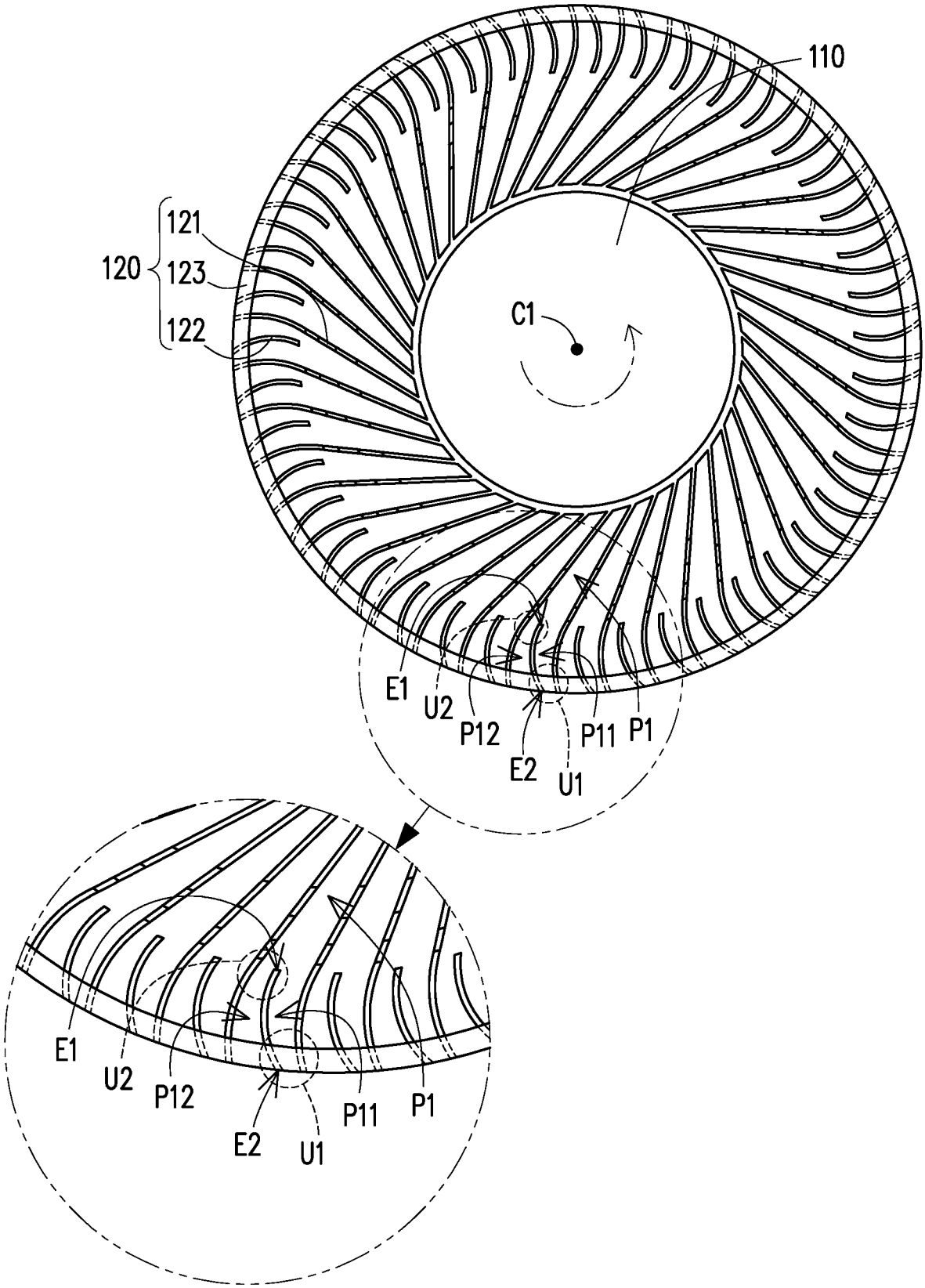
FIG. 1C is a top view of the hub and blades of FIG. 1B.

FIG. 1A is a schematic of a heat dissipation fan according to an embodiment of the invention. FIG. 1B is a schematic of a hub and blades in the heat dissipation fan of FIG. 1A. FIG. 1C is a top view of the hub and blades of FIG. 1B. Please refer to FIG. 1A to FIG. 1C at the same time. In the present embodiment, a heat dissipation fan 100 is, for example, a centrifugal fan including a housing 130, a hub 110, and a blade structure 120. The hub 110 is rotatably disposed in the housing 130 along an axis C1. The blade structure 120 is disposed at the surrounding edge of the hub 110 to be rotated with the hub 110, and the blade structure 120 has a plurality of blades. When the heat dissipation fan 100 is operated, the working fluid of the external environment enters the housing 130 via the air inlet located on the axial direction (the axis C1) of the heat dissipation fan 100 and is driven by the blade structure 120, and then is discharged from the air outlet located on the radial direction of the hub 110. The wide arrow shown in FIG. 1A represents the flow direction of the working fluid.

Please refer further to FIG. 1B and FIG. 1C. In the present embodiment, two adjacent blades of the blade structure 120 form at least a flow path P1, and the flow path P1 has a reduction section away from the hub 110. Further, in the heat dissipation fan 100 of the present embodiment, the blade structure 120 further includes a ring body 123 for connecting the blades, wherein the blades include a plurality of first blades 121 connected to the hub 110 and a plurality of second blades 122 not connected to the hub 110. Here, each of the second blades 122 is located between two adjacent first blades 121, and the ring body 123 is connected to the top of the first blades 121 and the top of the second blades 122. Therefore, the first blades 121 and the second blades 122 are connected in series. At the same time, a first divided path P11, a second divided path P12, a first reduction section U1, and a second reduction section U2 are further formed, wherein the first reduction section U1 is located at the first divided path P11 and the second reduction section U2 is located at the second divided path P12. The reduction section herein means that the flow path P1 (including the first divided path P11 and the second divided path P12) has a tapered profile in a radial direction away from the hub 110, so that the working fluid of the external environment enters the housing 130 (shown in FIG. 1A) via the air inlet of the heat dissipation fan 100 and then is sent out along the flow path P1 by the driving of the blades (the first blades 121 and the second blades 122). Therefore, when the working fluid flows through the first reduction section U1 and the second reduction section U2, a pressurizing effect is achieved due to the tapered contours thereof. As a result, the wind pressure of the working fluid sent out from the air outlet of the heat dissipation fan 100 may be effectively increased.

Furthermore, the first reduction section U1 and the second reduction section U2 of the present embodiment are staggered from each other along a radial direction away from the hub 110. As shown in FIG. 1C, the second blades 122 have a first end E1 adjacent to the hub 110 and a second end E2 away from the hub 110 and the ring body 123 is connected to the second end E2 and the end of the first blades 121 away from the hub 110, such that the second end E2 of the second blades 122 and the end of the first blades 121 away from the hub 110 form the first reduction section U1 and form the second reduction section U2 with the first blades 121 at the first end E1 of the second blades 122.

In the present embodiment, the hub 110 and the blades and the ring body 123 of the blade structure 120 may be plastic injection-molded or made by metal stamping or bending, or may be made by mixing different materials of metal and plastic and insert molding.

Figure 2A:
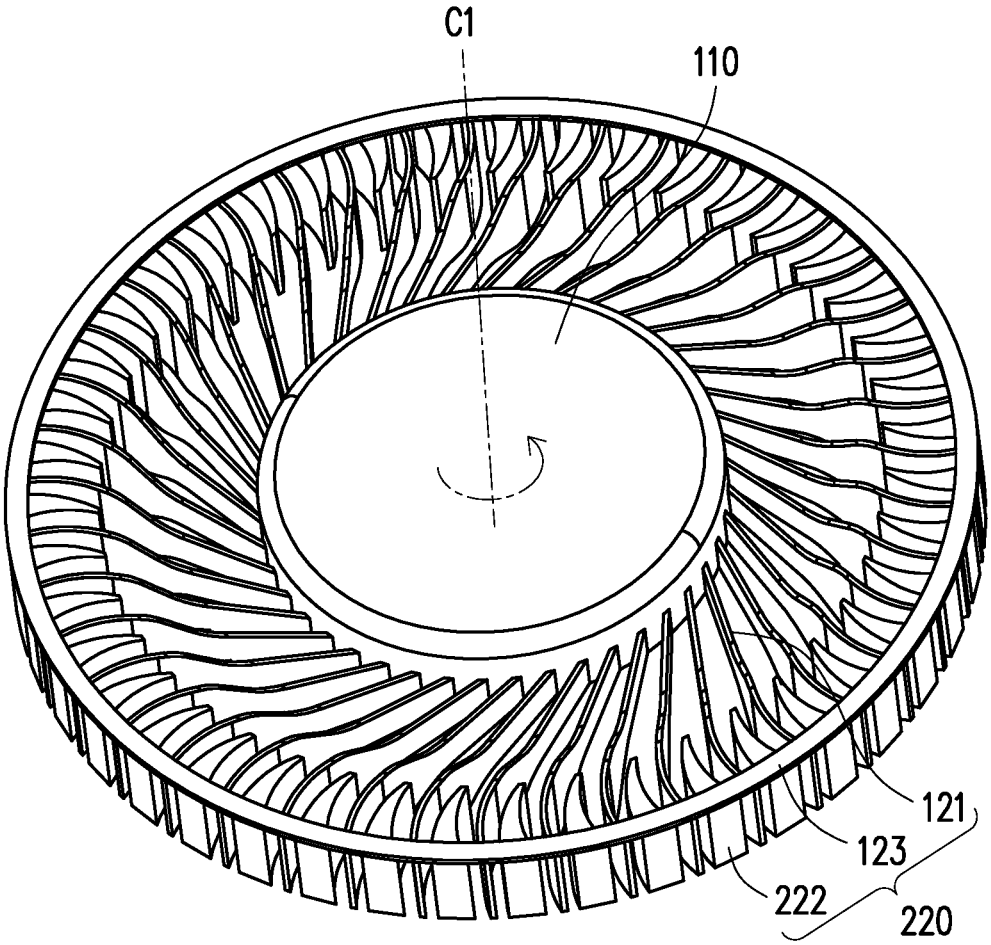
FIG. 2A is a schematic of a hub and blades according to another embodiment of the invention.
Figure 2B:
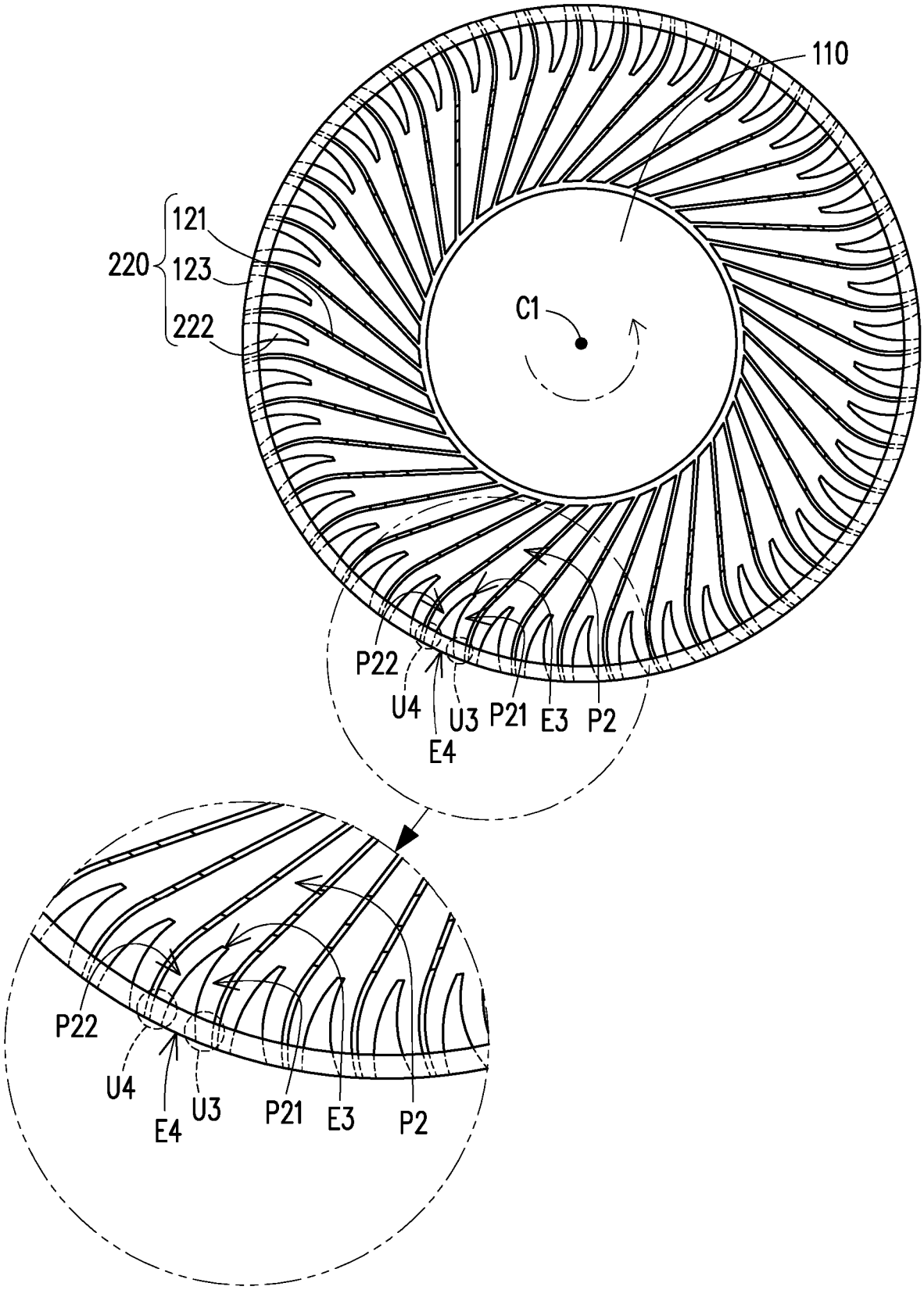
FIG. 2B is a top view of the hub and blades of FIG. 2A.

FIG. 2A is a schematic of a hub and blades according to another embodiment of the invention. FIG. 2B is a top view of the hub and blades of FIG. 2A. Please refer to FIG. 2A and FIG. 2B together. In the present embodiment, a blade structure 220 includes the ring body 123 and a partition 222, wherein the ring body 123 is connected to the plurality of first blades 121, two adjacent first blades 121 form a flow path P2, and the partition 222 is disposed at the ring body 123 and located between the two adjacent first blades 121. At the same time, the partition 222 is also located at the end of the first blades 121 away from the hub 110.

Here, the partition 222 and the two adjacent first blades 121 form a first divided path P21, a second divided path P22, a first reduction section U3, and a second reduction section U4, and are located on two opposite sides of the partition 222 respectively, wherein the first reduction section U3 is located at the first divided path P21, the second reduction section U4 is located at the second divided path P22, and the positions of the first reduction section U3 and the second reduction section U4 are consistent with each other along the radial direction of the hub 110, that is, as shown in FIG. 2B, the first reduction section U3 and the second reduction section U4 are substantially located at the ring body 123 (the reduction section shown in FIG. 2A is located below the ring body 123). The partition 222 has a first end E3 adjacent to the hub 110 and a second end E4 away from the hub 110, and the profile of the partition 222 is gradually expanded away from the hub 110, so as to form the first reduction section U3 and the second reduction section U4 for which the positions are consistent (both located at the second end E4) with the two adjacent first blades 121.

Here, the partition 222 and the ring body 123 may be an integrally formed structure. For example, the hub 110, the ring body 123, and the partition 222 may be made by insert injection molding with the first blades 121 made of metal.

Figure 3:
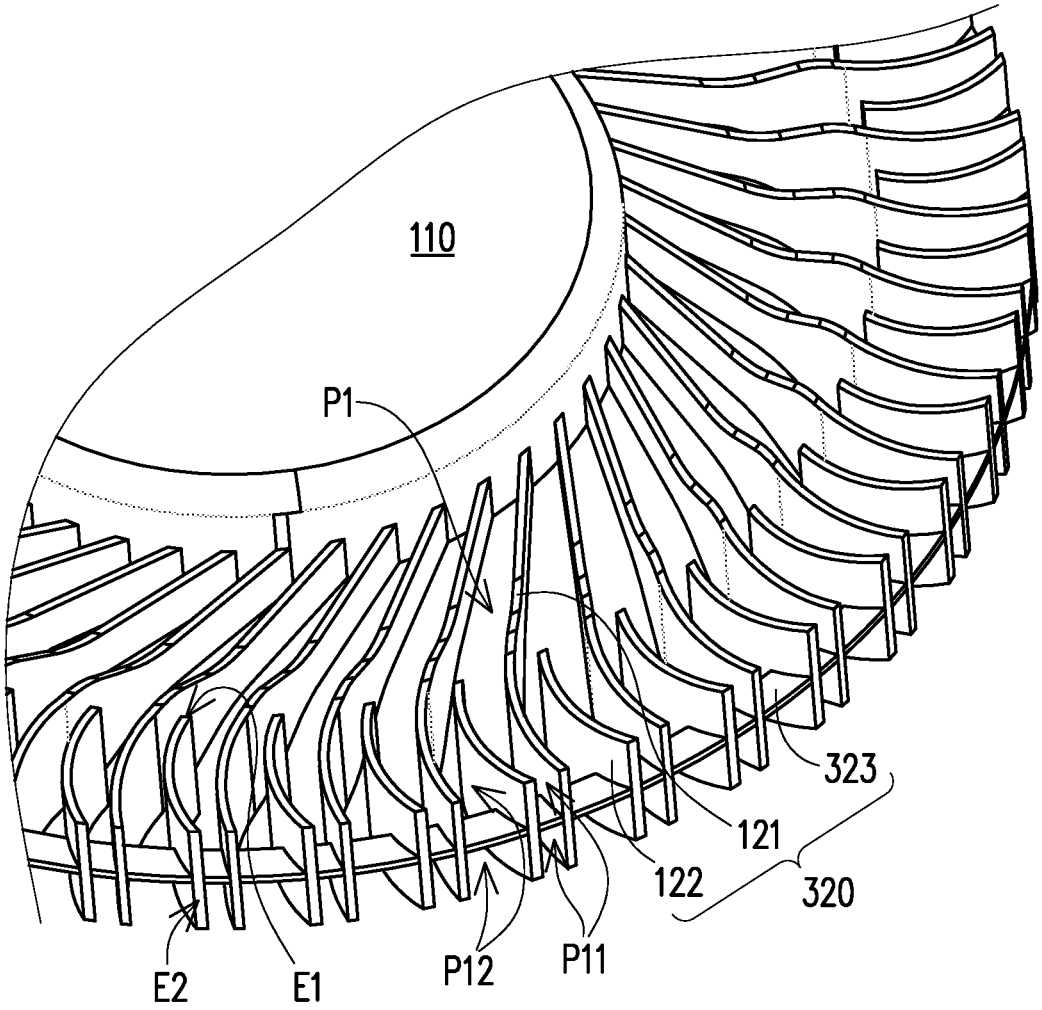
FIG. 3, FIG. 4, and FIG. 5 are partial schematics of a hub and blades of different embodiments of the invention, respectively.
Figure 4:
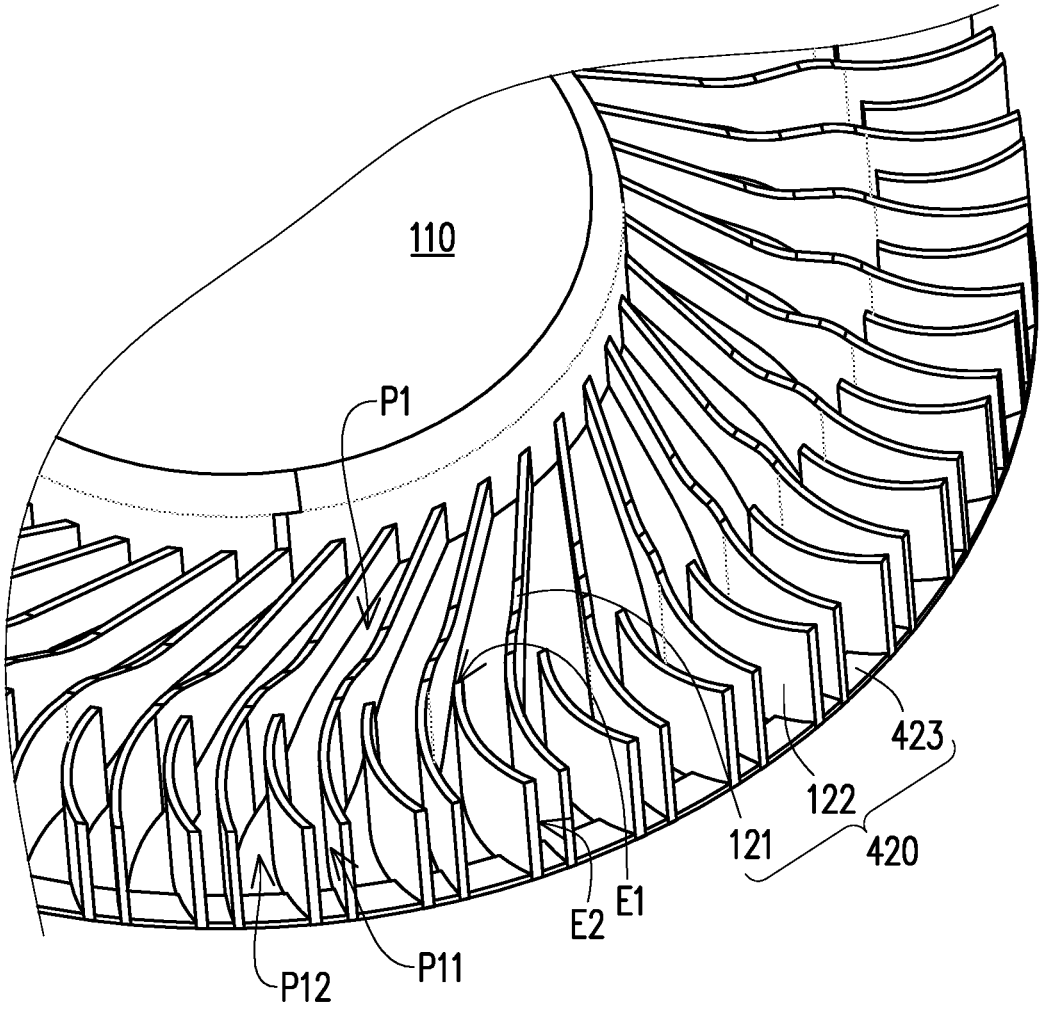
Figure 5:
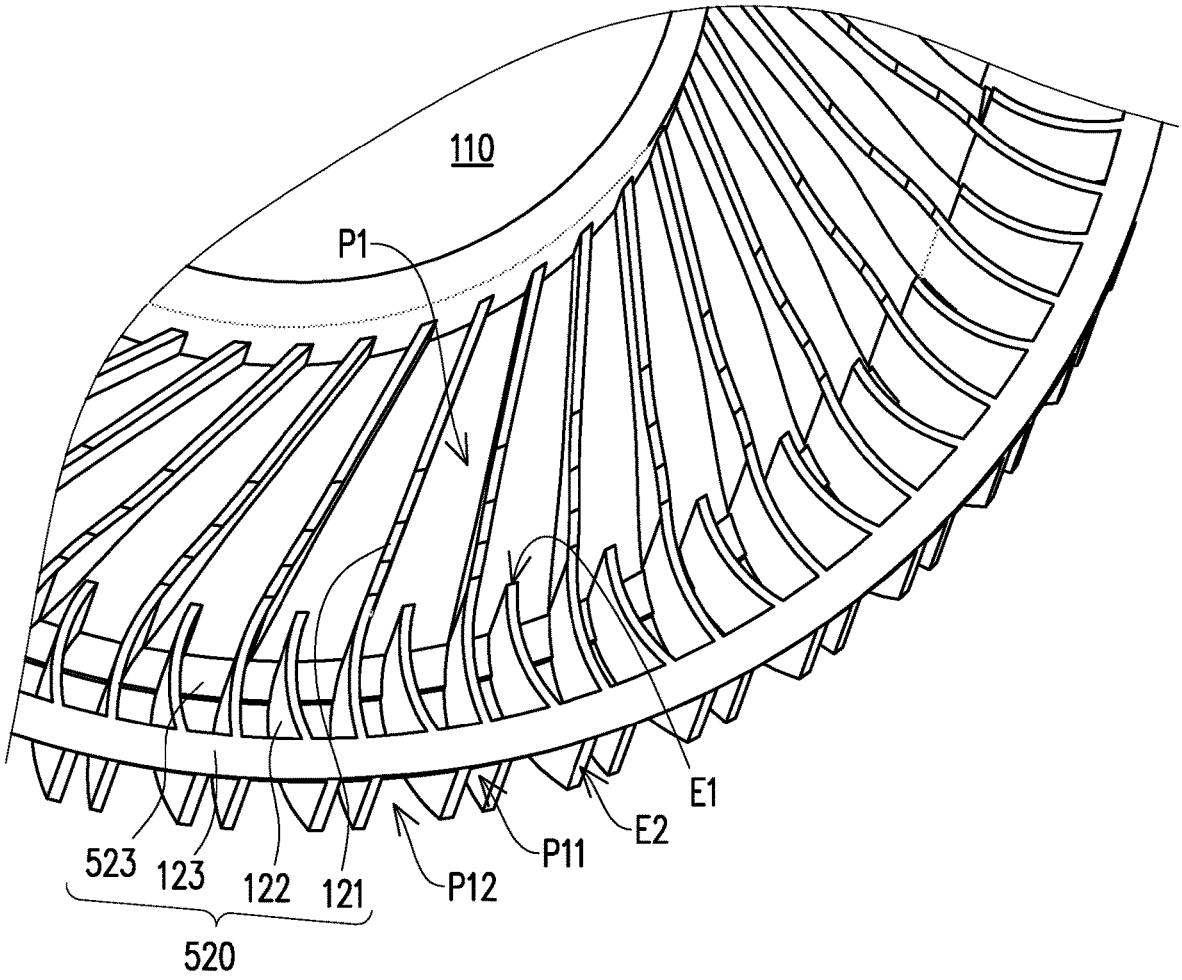

FIG. 3, FIG. 4, and FIG. 5 are partial schematics of a hub and blades of different embodiments of the invention, respectively. Please refer to FIG. 3 first. In a blade structure 320 of the present embodiment, the ring body 323 passes through the first blades 121 and the second blades 122 to divide the flow path P1 into layers along the axial direction, and the axial direction and the axis C1 of the hub 110 are consistent. As shown in FIG. 3, the first divided path P11 and the second divided path P12 are substantially divided into upper and lower layers.

Referring to FIG. 4, in a blade structure 420 of the present embodiment, a ring body 423 is connected to the top of the first blades 121 and the bottom of the second blades 122 to achieve a configuration opposite to the embodiment shown in FIG. 1B.

Please refer to FIG. 5. A blade structure 520 of the present embodiment includes the first blades 121, the second blades 122, and ring bodies 123 and 523. The difference from the above embodiments is that the ring bodies 123 and 523 have different radial sizes, wherein the ring body 123 is connected to the end of the first blades 121 away from the hub 110 and the second end E2 of the second blades 122, and the ring body 523 is connected to the first end E1 of the second blades 122 and the first blades 121 so that the structural strength and rigidity of the first blades 121 and the second blades 122 are increased via the dislocated ring bodies 123 and 523.

Figure 6:
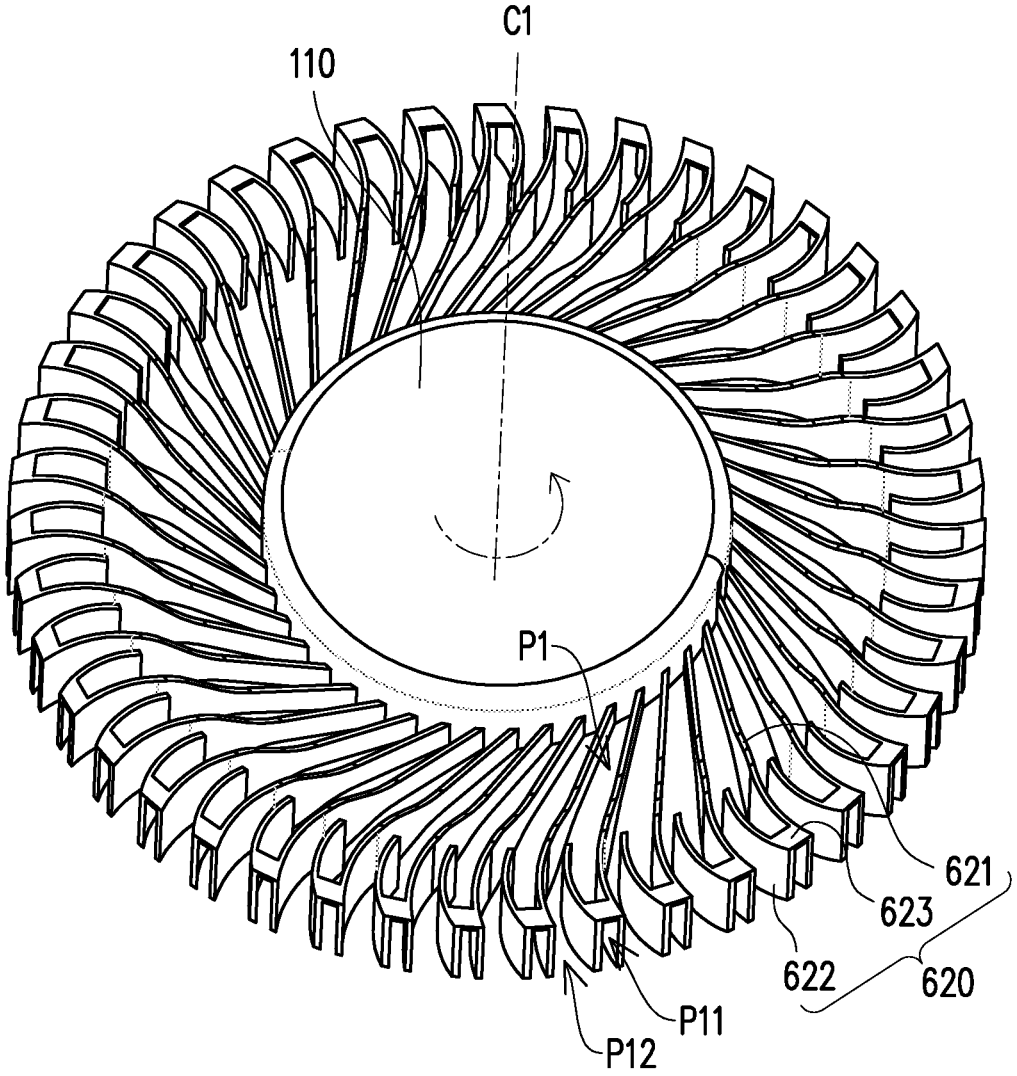
FIG. 6 is a schematic of a hub and blades of another embodiment of the invention.

FIG. 6 is a schematic of a hub and blades of another embodiment of the invention. Please refer to FIG. 6. In the present embodiment, a blade structure 620 includes first blades 621, second blades 622, and a connecting portion 623, wherein the first blades 621 are similar to the first blades 121 and are connected to the hub 110 and extended therefrom. The second blades 622 are similar to the second blades 122 and are located between two adjacent first blades 621 and are not connected to the hub 110. Furthermore, the connecting portion 623 of the present embodiment is connected between the end of the first blades 621 away from the hub 110 and the end of the second blades 622 away from the hub 110. Here, the first blades 621, the second blades 622, and the connecting portion 623 are formed by stamping and bending a metal plate, and thus have both the structural strength of an integrated structure and the effect of a simplified manufacturing process.

Based on the above, in the above embodiments of the invention, in the heat dissipation fan, at least one flow path is formed between the blades, and at the same time the flow path is provided with a reduction section, and therefore a pressurizing effect is provided to the airflow flowing through the reduction section, thereby increasing the air pressure of the heat dissipation fan so as to effectively solve existing heat dissipation issues.

In addition, the reduction section is provided with a second blade or a partition between two first blades extended from the hub, and a ring body is provided to facilitate connection. Therefore, the blade gap may be smoothly reduced at the end away from the hub to achieve the effect of pressurizing the working fluid leaving the blades.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A heat dissipation fan, comprising:

a housing;

a hub rotatably disposed in the housing; and a blade structure disposed at a surrounding edge of the hub to be rotated with the hub, wherein the blade structure has a plurality of first blades and a plurality of second blades spaced apart from each other, wherein the first blades are connected to the hub, the second blades are not connected to the hub, when the heat dissipation fan is operated, the two adjacent first blades form a flow path, each of the second blades is located between the two adjacent first blades to form two divided paths branching from the flow path, in a direction away from the hub, one of the divided paths is continuously tapered, and the other of the divided paths is continuously expanded.

2. The heat dissipation fan of claim 1, wherein the blade structure further comprises at least one ring body connected to the first blades and the second blades.

3. The heat dissipation fan of claim 2, wherein the ring body is connected to a top of the first blades and a top of the second blades.

4. The heat dissipation fan of claim 2, wherein the ring body passes through the first blades and the second blades to divide the flow path into layers along an axial direction, and the axial direction and an axis of rotation of the hub are consistent.

5. The heat dissipation fan of claim 2, wherein the ring body is connected to a bottom of the first blades and a bottom of the second blades.

6. The heat dissipation fan of claim 1, wherein the two divided paths comprise a first divided path, a second divided path, a first reduction section, and a second reduction section, the first reduction section is located at the first divided path, the second reduction section is located at the second divided path, and the first reduction section and the second reduction section are staggered from each other along a radial direction of the hub.

7. The heat dissipation fan of claim 1, further comprising a pair of ring bodies respectively connected to the first blades and the second blades.

8. The heat dissipation fan of claim 7, wherein the pair of ring bodies have different radial sizes.

9. The heat dissipation fan of claim 7, wherein the second blades have a first end adjacent to the hub and a second end away from the hub, one of the pair of ring bodies is connected to the first blades and the second ends of the second blades, and the other of the pair of ring bodies is connected to the first blades and the first ends of the second blades.

10. The heat dissipation fan of claim 1, wherein the blades further comprise a connecting portion connected between the first blades and the second blades, the connecting portion is connected between an end of the first blades away from the hub and an end of the second blades far from the hub, and the second blades are located between two adjacent first blades.

11. The heat dissipation fan of claim 10, wherein the first blades, the second blades, and the connecting portion are formed by stamping and bending a metal plate.

12. The heat dissipation fan of claim 1, wherein the heat dissipation fan is a centrifugal fan.

13. The heat dissipation fan of claim 1, wherein the first blades and the second blades are metal blades.

14. A heat dissipation fan, comprising:

a housing;

a hub rotatably disposed in the housing; and a blade structure disposed at a surrounding edge of the hub to be rotated with the hub, wherein the blade structure has a plurality of first blades and a plurality of second blades spaced apart from each other, wherein the first blades are connected to the hub, the second blades are not connected to the hub, when the heat dissipation fan is operated, the two adjacent first blades form a flow path, each of the second blades is located at the flow path and a width of the second blades gradually increases in a direction away from the hub, to form two divided paths branching from the flow path, and in the direction away from the hub, the two divided paths are continuously tapered.

15. The heat dissipation fan of claim 14, wherein the blade structure further comprises at least one ring body connected to the first blades and the second blades.

16. The heat dissipation fan of claim 14, wherein the two divided paths comprise a first divided path, a second divided path, a first reduction section, and a second reduction section, the first reduction section is located at the first divided path, the second reduction section is located at the second divided path, and the first reduction section and the second reduction section are located at the end of the first blade and at the end of the second blade.

17. The heat dissipation fan of claim 14, wherein the heat dissipation fan is a centrifugal fan, and the first blades and the second blades are metal blades.

* * * * *